US005113536A

United States Patent [19]

Osmond

[11] Patent Number: 5,113,536

[45] Date of Patent: May 19, 1992

[54] JET ACTIVATED TOILET FLUSHING APPARATUS

[76] Inventor: John S. Osmond, 731 Cedar St., Santa Monica, Calif. 90405

[21] Appl. No.: 550,555

[22] Filed: Jul. 10, 1990

[51] Int. Cl.[5] ..... E03D 1/06; E03D 1/07

[52] U.S. Cl. ..... 4/368; 4/372; 4/365; 137/142

[58] Field of Search ..... 4/368, 372, 373, 374, 4/375, 376, 386, 365, 378; 137/142, 149, 147

[56] References Cited

U.S. PATENT DOCUMENTS 577,021 2/1897 Groszmann ..... 4/365

FOREIGN PATENT DOCUMENTS 13703 of 1900 United Kingdom ..... 4/368

*Primary Examiner*—Henry J. Recla
*Assistant Examiner*—David J. Walczak
*Attorney, Agent, or Firm*—William H. Maxwell

[57] ABSTRACT

A toilet flushing apparatus characterized by an inherently leakproof syphon, primer and flush tube aligned with a flush pipe into the toilet, with a jet opening from the discharge of the syphon to initiate flushing when a charge of water is manually dumped from a bucket and through the flush tube.

10 Claims, 3 Drawing Sheets

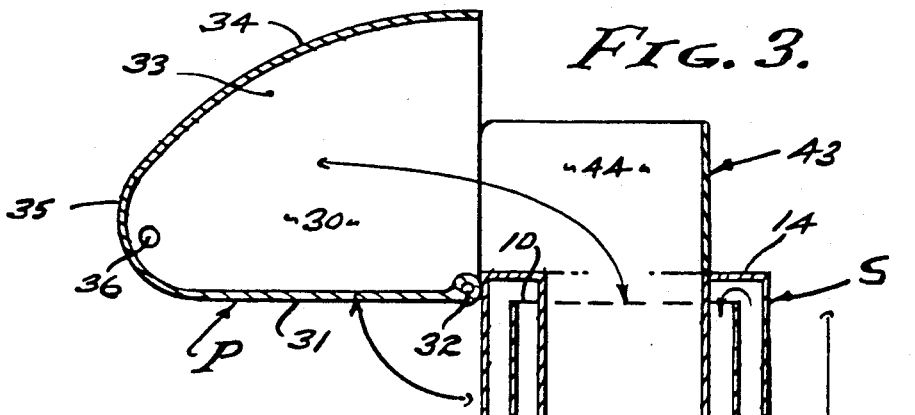
FIG. 3.
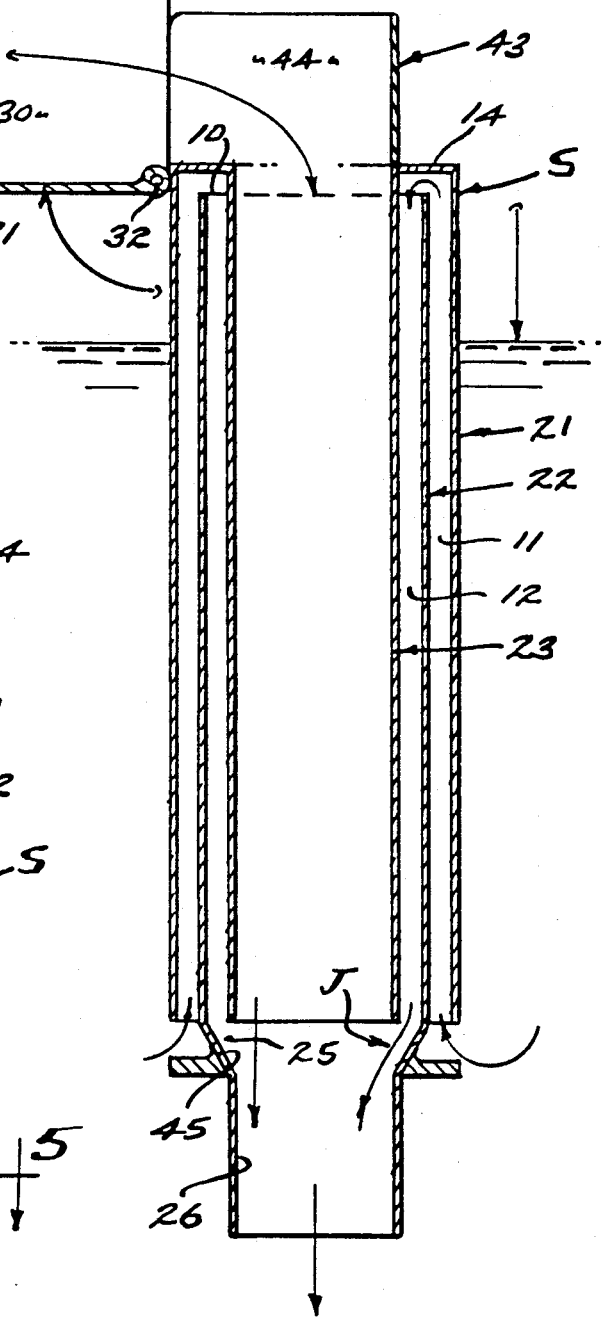
FIG. 4.
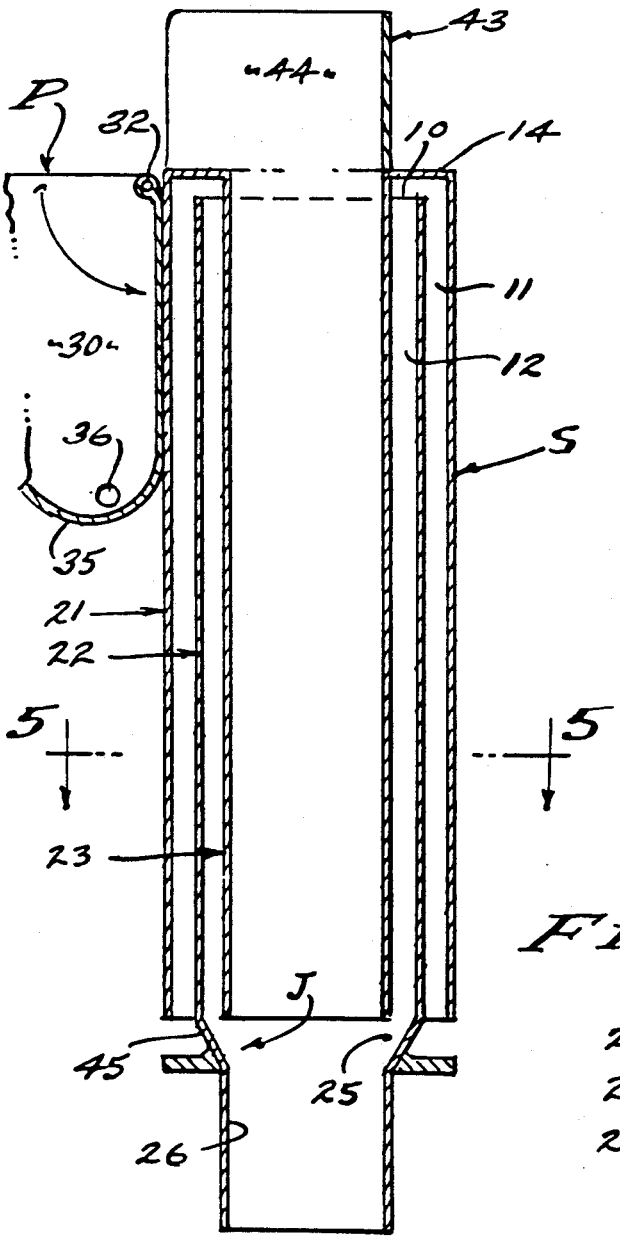
FIG. 5.
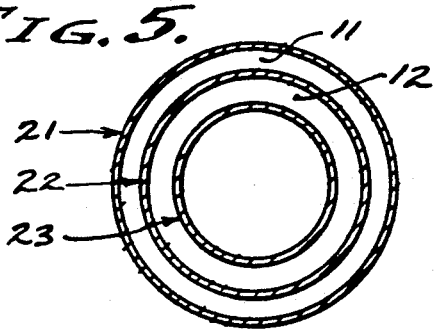

34'
42'
35'
14
30'
10
33'
32'
36'
11
12
23
J
25
26
42'
14
34'
10
35'
30'
32'
36'
11
12
23
J
25
26

JET ACTIVATED TOILET FLUSHING APPARATUS

BACKGROUND OF THE INVENTION

A common flushing apparatus for toilets involves a reseating flush valve that holds a large volume of supply water in a tank from which it is suddenly released into the toilet bowl. And a float valve is responsive to the water level in the tank to replace the water level, operating automatically and separately from the flush valve that is manually operated by movement of a flush handle or lever that is turned to lift the flush valve. A detrimental feature of this common system is that the flush valve tends to and eventually leaks, resulting in water waste.

Another flushing apparatus, common in the United Kingdom, involves a syphon tube having its suction leg depending into the supply tank so as to be filled with water, and its discharge leg normally empty of water and opening into the toilet bowl, and operated by means of a primer pump that is manually actuated to fill the discharge leg thereby initiating syphoning. The said primer pump operates as a water lifting means in the suction leg of the syphon. The advantage of this syphon system is that there can be no leakage from the supply tank through the inactive syphon. However, the pump means gradually deteriorates and requires repeated cycles of operation in order to complete a flushing of the toilet, and inevitably becomes inoperative.

In view of the foregoing, it is an object of this invention to employ the aforesaid syphon tube flush principle of operation to the exclusion of a pump means, and replacing the aforesaid pump-type primer means with a tank-type primer means, all in combination with an otherwise conventional toilet having a water supply tank but to the exclusion of the conventional flush valve.

The syphon principle of operation is superior with respect to the conservation of water, in that there can be no continuous leakage therethrough when its discharge leg is empty of water. And, only when the discharge leg is primed does water flow therethrough and through the flush tube. On the contrary, the flush valve principle of operation is prone to continuous leakage from the water supply tank and through the flush tube, due to deterioration of either the valve seat or valve ball element. It becomes apparent therefore that the syphon principle is superior, except for the inevitable deterioration of the pump means therefor which is typically a flap or disc of flexible material that lifts the tank water into the syphon and initiates continued flow therethrough until the water supply tank is emptied through the flush tube. Accordingly, these two widely used principles of operation are each subject to deficiencies, one to inherent leakage and the other to eventual inoperation. In view of the foregoing, it is an object of this invention to provide a toilet flushing apparatus that virtually eliminates leakage of the flush water control means, and that eliminates valve and/or pump devices as flush control means.

It is to be understood that the water supply tank is refilled after each flushing operation, by means of a conventional and accepted water level responsive valve means from a water supply service pipe. In practice, a float controlled valve returns the tank water level to the bridge of the syphon after each flushing operation.

The syphon principle of operation is characterized by two conditions, a passive condition wherein the discharage leg is dry, and a functioning condition wherein the discharge leg is wet. In order to achieve said wet condition priming is required for filling the otherwise dry discharge leg with water, whereby syphoning action is initiated and continues to occur. It is an object of this invention to prime the syphon by discharging a relatively small volume of water through the flush tube so as to have a jet pump effect on the syphon. In practice, the opening of the syphon discharge leg in to the flush tube forms a jet pump configuration that enables the syphon to function when flooded with a downward velocity of water suddenly dumped therethrough. Accordingly, the apparatus herein disclosed is characterized by a manually acutated primer means, preferably a dump tank, that floods the flush tube at a jet pump opening from the discharge leg of the syphon.

SUMMARY OF THE INVENTION

This invention relates to water closets or toilets and particularly to the flushing apparatus therefor by which defecation and urination etc. is disposed of as sewage. Heretofore, substantial quantities of water have been wasted by the flushing apparatus employed, as by inherent leakage and by mechanical deterioration resulting in malfunctions and/or insufficient operation requiring repeated flushing. The flush valve type of apparatus that is manually activated to open the conventional flush tube is subject to continuous leakage and waste of water, while the non-leak syphon type apparatus inevitably deteriorates mechanically and eventually becomes inoperative. However, it is an object of and this invention combines the advantage of the non-leak syphon type apparatus with a jet pump and primer means, whereby both the pump primer means and flush valve are eliminated.

The toilet flushing apparatus herein disclosed is jet activated, simply by flooding the flush pipe with water velocity at a syphon discharge opening in order to initiate syphoning that depletes the water supply tank during each flushing operation. Accordingly, this invention is characterized by a jet pump means established by the syphon discharge opening into the flush tube, and by a primer means that is activated to flood said jet pump means with water velocity sufficient to initiate syphoning. In practice, the flush tube flow capacity is such as to require but a small quantity of water, a pint or two, discharged a short height, approximately six or seven inches, above the syphon discharge opening into the flush tube. Thus, the volume of primer water is relatively small, it is to be understood that operation of the flushing apparatus is dependent upon refilling of the water supply tank by a water level control, such as a float controlled water supply valve or the like, so that the tank water returns to the bridge level of the syphon after each flushing operation.

The foregoing and various other objects and features of this invention will be apparent and fully understood from the following detailed description of the typical preferred forms and applications thereof, throughout which reference is made to the accompanying drawings.

THE DRAWINGS

FIG. 3 is an enlarged view of the flushing apparatus removed from the toilet, and showing the actuated condition with flushing initiated.

FIG. 4 is a view similar to FIG. 3, showing the apparatus empty of water as it is after flushing and ready for refilling.

FIG. 5 is a view taken as indicated by line 5—5 on FIG. 4.

Figure 1:
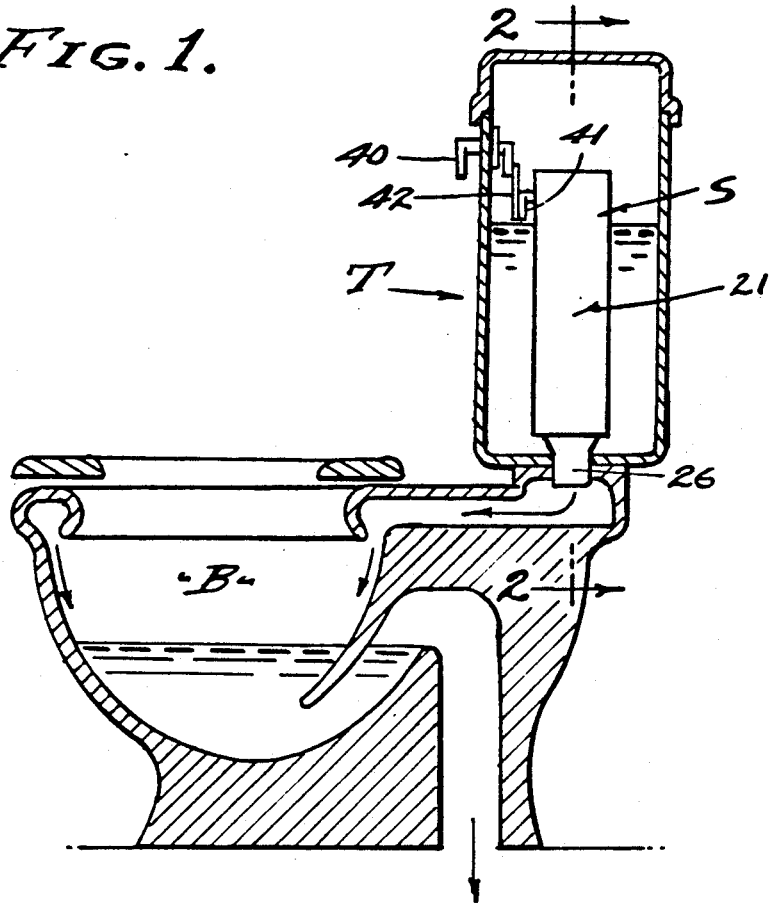
FIG. 1 is cross sectional view of a toilet with the flushing apparatus of the present invention installed therein.
Figure 2:
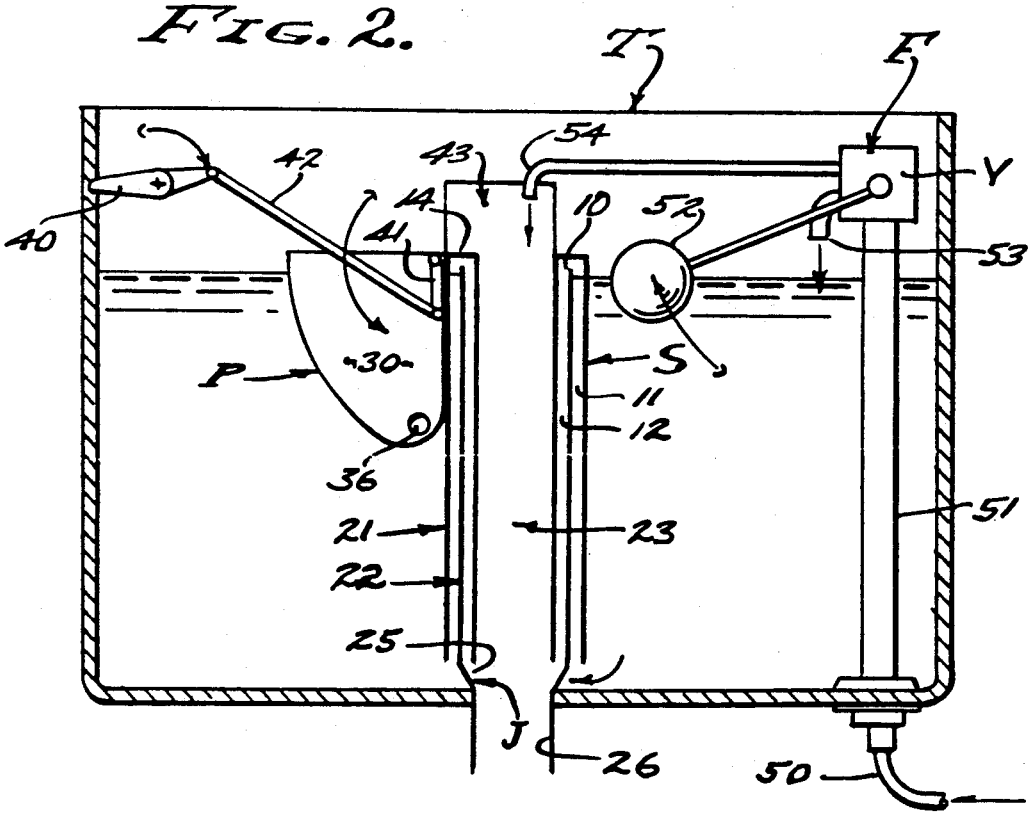
FIG. 2 is an enlarged sectional view taken as indicated by line 2—2 on FIG. 1, showing a passive ready condition.
Figures 6, 7:
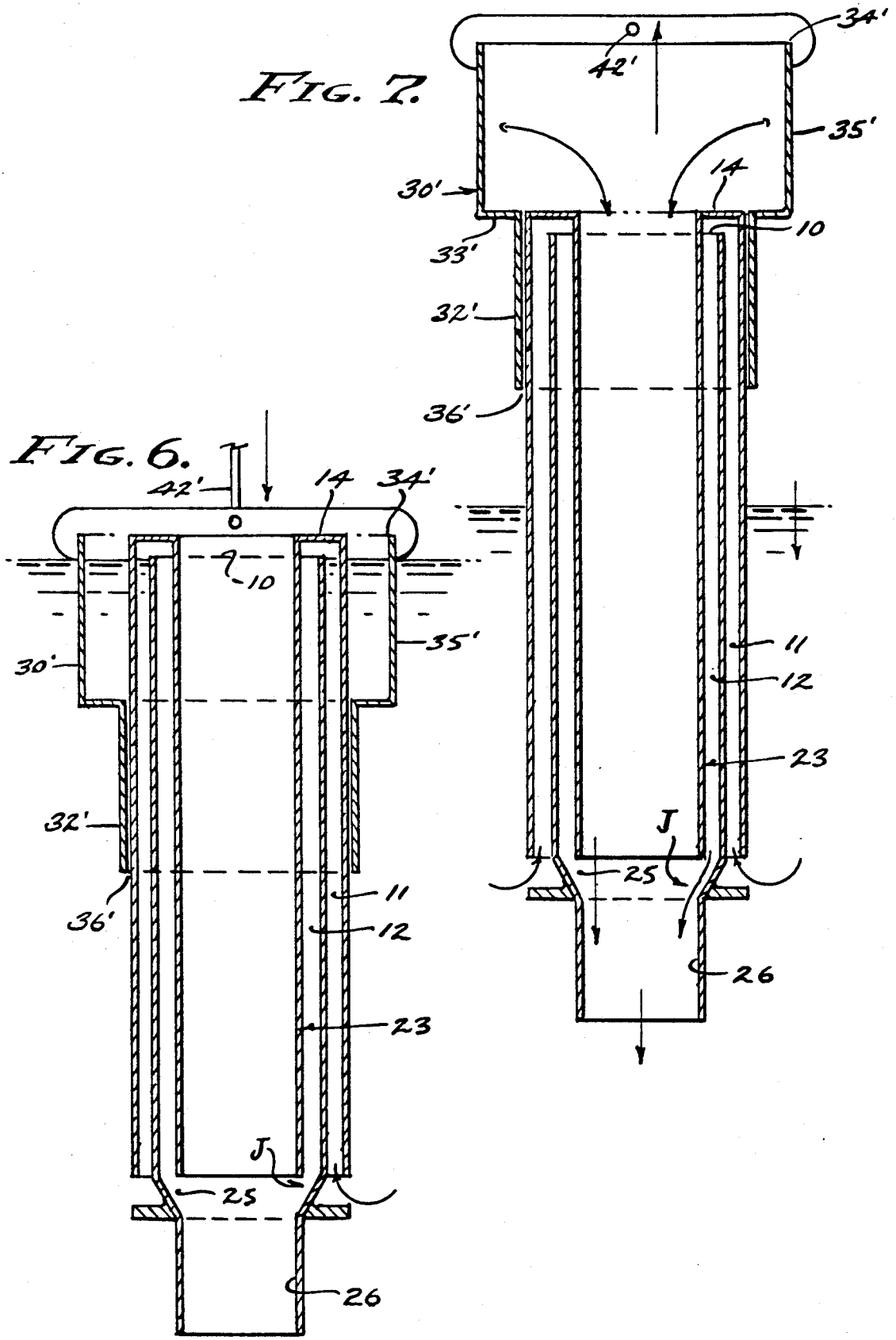
FIG. 6 shows a second embodiment, characterized by a sliding dump bucket as distinguished from a pivoted dump bucket.

And,

FIG. 7 is a view similar to FIG. 6, showing the actuated flush condition thereof.

PREFERRED EMBODIMENT

Referring now to the drawings, the toilet and water supply tank T are conventional in every respect. And, the tank water level is controlled by a conventional float valve F, so that the water supply level reaches a position just below a weir referred to herein as a bridging section or bridge 10 of a syphon S within the tank. A feature of this invention is the syphon S comprised of a suction leg 11 and a discharge leg 12, preferably concentric tubes 21,22 and 23 wherein the suction leg 11 is an annulus that surrounds the discharge leg 12 and wherein said discharge leg 12 is an annulus surrounding a flush tube 23. The suction leg 11 opens from the bottom of the tank T and into the top of the discharge leg 12 via a closed header 14, the suction leg 11 being filled with tank water to the bridge 10 level, and the discharge leg drained empty after each flushing. The header 14 closely overlies the top level of tube 22 and extends between tube 21 and 23 forming a closed upper transfer passage joining the two legs, said passage being empty when the water level rises to a maximum at the bridge 10 of the syphon. The discharge leg 12 and said upper transfer passage remain empty of water after each flushing, while the suction leg refills.

In accordance with this invention, there is a jet pump means J and a primer means P combined with the syphon S, for activation to flush the toilet bowl B with a substantially full charge of tank water at each flushing. In practice, the flush tube will be approximately two inches in diameter and of the aforementioned height, so as to have a nominal displacement volume, and open top and bottom for free passage of water to flow by gravity therethrough. The tubes 21, 22 and 23 are concentric with annuli 11 and 12 substantially equal in area with each other and to the area of the inner diameter of flush tube 23. It is to be understood that these cross sectional areas can vary in order to obtain utmost efficiency.

Referring now to the jet pump means J, such pumps operate without moving parts and are capable of moving a greater volume of fluid than is required therefor through the ejector feature for operation. Said ejector feature can vary widely, however it is required that there be an opening 25 exposed to a moving body of fluid, in this instance a body of water at a velocity moving downwardly through the flush tube 23 and exposed to an opening from the bottom of the discharge leg 12. Since the flush tube 23 is circular and the discharge leg is annular, the jet opening 25 is preferably a continuous circular slot-shaped opening formed by the terminal bottom end of the tube 23 juxtaposed to the terminal top end of the toilet flush pipe 26 of the same diameter as tube 23. It is to be understood that there can be other arrangements, providing that there is at least one jet opening in open communication between the discharge leg 12 and the flush tube 23—pipe 26. For example, there may be one or a series of circumferential jet openings or pipes, as may be required. The flush pipe 26 discharges into the toilet bowl B in a conventional manner as shown.

Referring now to the primer means P and P', the flush tube 23 is flooded thereby with water that rushes by gravity to flow over the jet opening or openings 25. The rush of water has a drawing action that reduces pressure in the discharge leg 12 with suction sufficient to ensure the rise of water from the suction leg 11 causing it to flow over the bridge 10 and through the transfer passage to fall through the discharge leg 12. The close proximity of the leg walls 22 and 23 is confined and such as to establish a solid liquid wall of water that ensures the initiation of syphoning which then inherently continues. The discharge area of the jet opening 25 is substantially the same as the aforementioned areas of legs 11 and 12 and of the flush tube 23 and flush pipe 26 as well. Accordingly, there is an unrestricted rush of flush water from the syphon S and into the toilet bowl B.

The primer means P is an inherently leak-proof device, preferably a dump-tank or bucket 30 adapted to automatically fill with supply tank water and to dump the same by manual actuation into the flush tube 23. Height of the apparatus is of concern, and to this end it is a feature of the primer means bucket 30 that it is submerged into the tank supply water when in its passive ready-to-flush condition. Accordingly, the bucket 30 is carried at or about the bridge 10 height of the tube combination, so as to alternately depend into the supply water surrounding or at one side of the suction leg 11, or to be raised to the level of header 14 so as to discharge a limited volume of water thereover and into the flush tube 23. In practice, the bucket 30 has a bottom 31 pivoted by a hinge 32 to one side of the outer tube 21, at the level of the header 14, said bottom being capable of swinging up from a down position to a substantially horizontal or raised position. The bucket has opposite sides 33 between which a top 34 extends to form a pocket to carry said limited volume or charge of water that is aquired when the bucket is submerged. In practice, the outer and/or lower extremities of the bottom 31 and top 34 are of plate form that converge to establish a substantially triangular pocket-like chamber having an apex 35 adapted to be raised from a lowered water gathering position.

In carrying out this invention and in order to reduce apparatus height, the top 34 is involutely curved from the apex 35, which not only reduces the lever arm resistance to raising the bucket, but also substantially reduces its height when fully raised. Small fill openings 36 enter into the bucket at the apex 35, so as to permit sinking and automatic refilling thereof.

Activation of the bucket 30 is manual through a hand operated lever 40 directly or indirectly connected to the bucket 30. as shown, a bucket lever 41 is angularly displaceable with a pull rod 42 coupled to the hand operated lever 40 so as to raise the bucket as required.

Assuming the bucket 30 to be fabricated of plastic material, its specific gravity will be substantially that of water, so as to afford little or no resistance to being raised. Likewise, the water level in the bucket 30 is initially that of the water level in the supply tank T, so as to afford little resistance to accelerated raising as the bucket is turned. Since the bucket 30 is entirely open between the top and bottom plates, the water therein is increasingly accelerated to flow over the header 14 and into the flush tube 23. A collector shield 43 funnels the bucket discharge into the flush tube, said shield having side walls 44 aligned with sides 33 of the bucket. The water dumping function is dynamic and takes place during a short period of time with minimal spillage. Practically all of the discharge water is confined to enter the flush tube 23. And, the bucket 30 returns to its passive ready-to-flush down position by means of gravity. No seals are required between the bucket 30 and flush tube 23, the primer water charge being directed by the shield 43.

In carrying out this invention, a flush unit is provided as clearly shown throughout the drawings. That is, the water flow tubes 21,22 and 23 are integrally joined at the header 14 and to the flow pipe 26, with the bucket 30 secured thereto by the hinge 31. As shown, the tube 22 is joined to the flow pipe 26 by an inclined bottom wall 45 and mounted to the bottom of the tank T, and also establishing the lower edge of the slot-shaped jet opening 25. Alternately, the tube 22 and/or wall 45 is mounted directly to the bottom of the tank T.

The float valve F can be any suitable water level control as they are available for refilling the toilet tank T as shown and herein described. The water supply 50 enters the bottom of tank T, through a standpipe 51, there being a float 52 responsive to the water level to open and to close a valve V. The valve V discharges water at 53 into the tank T, and also discharges a proportional volume of water at 54 into the flush tube 23—pipe 26, to ensure thorough flushing.

Referring now to a second embodiment as shown in FIGS. 6 and 7 of the drawings, the dump tank or bucket 30' is a cylinder surrounding the header 14 and adapted to automatically fill with supply tank water and to dump the same by manual actuation into the flush tube 23. It is also a feature of this primer means bucket 30' that it is submerged into the tank supply water when in its passive ready-to-flush condition (see FIG. 6). Accordingly, the top 34' of the bucket 30' is positioned above the high water level in tank T, at or about the bridge 10 height of the tube combination, so that the bucket depends into the supply water when in the passive down position surrounding the suction leg 11. The bottom 33' of the bucket 30' is spaced a substantial distance below the top 34' by its outer wall 35', preferably a cylindrical outer wall that establishes a storage annulus around the outer tube 21 in order to contain a charge of water sufficient for initiating syphoning.

The bucket 30' is slidably carried on the outer tube 21 by a closely fitted sleeve 32', whereby the water charge is lifted when the bottom 33' of the bucket is raised to the level of header 14 so as to dump said charge of water thereover and into the flush tube 23. In practice, the sleeve 32' is sufficiently loose on the tube 21 to provide a restricted fill opening 36' entering into the bucket at the bottom 33', so as to permit sinking and automatic refilling thereof. Activation of the bucket 30' is manual through the hand operated lever 40 directly or indirectly connected thereto by a pull rod 42' coupled to the hand operated lever so as to raise and lower the bucket as required. The bucket 30' is fabricated of plastic material so that its specific gravity will be substantially that of water, and so as to afford little or no resistance to being raised. The water level in bucket 30' is inherently that of the water level in the supply tank T, so as to afford little resistance to accelerated raising as the bucket is lifted. Since the top 34' of bucket 30' is entirely open, the flush valve F discharges therein at 54. No seals are required between the bucket 30' and syphon tube 21, the primer water charge being dumped inwardly as it is restrained otherwise by the cylinder wall 35'.

Having described only the typical preferred forms and applications of my invention, I do not wish to be limited or restricted to the specific details herein set forth, but wish to reserve to myself any modifications or variations that may appear to those skilled in the art, as set forth within the limits of the following claims.

I claim:

1. A flushing apparatus for toilets having a flush tank and a flush pipe opening therefrom and into a toilet bowl, and having a water level control means responsive to depletion of water in said tank to refill said tank to a predetermined water level, said apparatus including;

a syphon adapted to be mounted within the flush tank and comprised of a suction leg having an inlet opening adjacent to the bottom of said tank and extending upward to a bridging section at the aforesaid predetermined water level, and a discharge leg contiguous with the suction leg and extending downward from the bridging section to a discharge opening adjacent the bottom of said tank and which is directed toward the aforesaid flush pipe of the toilet, a flush tube adapted to be mounted within the flush tank and having an open upper end above the predetermined water level and an open lower end at said discharge opening of the syphon discharge leg communicating with the interior of the lower end of the flush tube, and a primer means comprised of a bucket adapted to be mounted in said tank to turn from a water storage position to a discharge position for dumping a charge of water into the upper end of the flush tube and over the discharge opening of the discharge leg for inducing a suction effect in the discharge leg, whereby water from the suction leg is drawn over the bridging section and into the discharge leg to initiate a syphon to flush the tolet.

2. The flushing apparatus for toilets as set forth in claim 1, wherein the primer means bucket is mounted onto a header overlying the syphon bridging section to turn from a water storage position to a discharge position whereby water is dumped from the bucket into the upper end of the flush tube.

3. The flushing apparatus for toilets as set forth in claim 2, wherein a shield embraces the top of the flush tube and directs water dumped from the bucket and into the flush tube.

4. The flushing apparatus for toilets as set forth in claim 1, wherein the primer means bucket is adapted to be mounted in said tank to alternately turn from a submerged position in the tank water to a discharge position whereby water is dumped from the bucket into the upper end of the flush tube.

5. The flushing apparatus for toilets as set forth in claim 1, wherein the primer means bucket is pivoted to a side of a shield overlying the syphon bridging section to turn from a submerged position in the tank water to a discharge position over the header and whereby water is dumped from the bucket into the upper end of the flush tube.

6. The flushing apparatus for toilets as set forth in claim 1, wherein a shield embraces the top of the flush tube and directs water dumped from the bucket and into the flush tube.

7. The flushing apparatus for toilets as set forth in claim 1, wherein manually operable actuating means dumps the primer means from a passive condition.

8. The flushing apparatus for toilets as set forth in claim 1, wherein manually operable lever means turns the bucket from the water storage position to the discharge position.

9. The flushing apparatus for toilets as set forth in claim 1, wherein the suction leg and discharge leg of the syphon are concentric tubes concentrically surrounding the flush tube, wherein the flush tube has a bottom terminal end spaced above a top terminal end off the flush pipe, the discharge opening of the syphon discharge leg being defined by said spaced terminal ends, and wherein the primer means bucket is adapted to be mounted in said tank to turn from a water storage position to a discharge position whereby water is dumped from the bucket into the upper end of the flush tube.

10. The flushing apparatus for toilets as set forth in claim 1, wherein the suction leg and discharge leg of the syphon are concentric tubes concentrically surrounding the flush tube, wherein the flush tube has a bottom terminal end spaced above a top terminal end of the flush pipe, the discharge opening of the syphon discharge leg being defined by said spaced terminal ends, and wherein the primer means bucket is adapted to be mounted in said tank to alternately turn from a submerged position in the tank water to a discharge position whereby water is dumped from the bucket into the upper end of the flush tube.

* * * * *